US005449014A

United States Patent [19]

Yan-ho

[11] Patent Number: 5,449,014

[45] Date of Patent: Sep. 12, 1995

[54] INDIVIDUAL TEMPORARY SHELTER APPARATUS

[76] Inventor: Tang Yan-ho, 918 China Hong Kong City Tower III, Tsimshatsui, Kowloon, Hong Kong

[21] Appl. No.: 191,784

[22] Filed: Feb. 2, 1994

[51] Int. Cl.[6] ..... E04H 15/30

[52] U.S. Cl. ..... 135/95; 135/156; 5/111; 5/113; 403/170; 403/107; 403/84; 16/361; 16/348; 297/54; 297/357

[58] Field of Search ..... 135/87, 96, 105, 95; 5/110, 111, 113, 114; 403/170, 217, 178, 107, 106, 104, 84; 297/129, 54, 357; 16/360, 361, 387, 348

[56] References Cited

U.S. PATENT DOCUMENTS

| | | | |
|---|---|---|---|
| 2,911,245 | 11/1959 | Kurz | 5/111 X |
| 3,601,825 | 8/1971 | Moorhead et al. . | |
| 3,822,422 | 7/1974 | Buntyn | 5/110 X |
| 4,200,406 | 4/1980 | Fuss | 403/217 X |
| 4,677,805 | 7/1987 | Schleisner | 403/170 X |
| 4,914,768 | 4/1990 | Howard | 5/113 |
| 5,018,227 | 5/1991 | Canfield | 5/111 X |
| 5,210,888 | 5/1993 | Canfield | 5/111 X |

*Primary Examiner*—Lanna Mai
*Attorney, Agent, or Firm*—Brian L. Kelly

[57] ABSTRACT

An individual temporary shelter apparatus is an apparatus which can act as a bed, lounge or chair with a complete enclosure including windows for cross ventilation, capable of withstanding wind and precipitation. The apparatus seals against insects and noxious fumes. The apparatus is portable in that it is entirely collapsible to a frame like that of a backpack and includes pockets and shoulder straps and a belt for supporting the frame on the back of the user much like a conventional backpack.

11 Claims, 4 Drawing Sheets

INDIVIDUAL TEMPORARY SHELTER APPARATUS

FIELD OF THE INVENTION

The present invention relates in general to a novel personal shelter apparatus.

BACKGROUND OF THE INVENTION

In the camping art there are a number of shelter devices ranging from the common pup-tent to a travel trailer. Two of the most common problems with known tents are the fact that the user sleeps on the hard ground which limits the comfort and increases the propensity for dew to accumulate on the bottom of the enclosure. The fact that the tents rests on the ground also reduces the overall temperature of the interior of the tent. Of course these shortcomings can be overcome by a travel trailer, however, travel trailers have limited use for inaccessible areas and, of course, include a great expense. There also appears to be a need for individual shelters in emergency situations such as natural disasters where a number of people will be sharing a large open gym or the like which will not provide individual privacy or a comfortable resting place. The invention overcomes these problems by providing a integral bed convertible into a lounge or a chair and which is raised above the ground and allows the weight of an user to be suspended from a lightweight frame and material stretched across the frame under tension to avoid the problem of sleeping on the hard ground and further incorporates an enclosure which can trap the body heat of the user to maintain the temperature therein. In the enclosure, an user can seal himself off from the view of others providing the privacy that is often lacking in a natural disaster situation. Further, because the invention suspends the bed portion above the ground, this shelter provides storage underneath each individual bed rather than forcing the disaster victims hold their personal items on their laps or the like.

SUMMARY OF THE INVENTION

Accordingly, one object of the present invention is to provide a portable, durable, individual temporary shelter. Another object of the invention is to provide a comfortable lounge and bed. A third object is to provide a sealed enclosure to prevent the intrusion of insects or noxious fumes.

Still another object is to provide a highly portable unit collapsible to the size of a backpack frame and having straps and pockets so as to act as a backpack.

It comprises a central planar member having a hinge means attached to a first end and to a second end which is opposite the first end. A leg member is attached to each hinge means and extends from a first side of the central planar member, such that the leg members support the central planar member. A suspension member is attached to each hinge means. There is also a support member attached to each hinge means, and an envelope having at least one opening for ingress is attached to the support member by a first attachment means and is suspended from said suspension members by a second attachment means.

These and other objects and advantages are provided by a novel individual temporary shelter according to the present invention.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DESCRIPTION OF PREFERRED EMBODIMENTS

Figure 1:
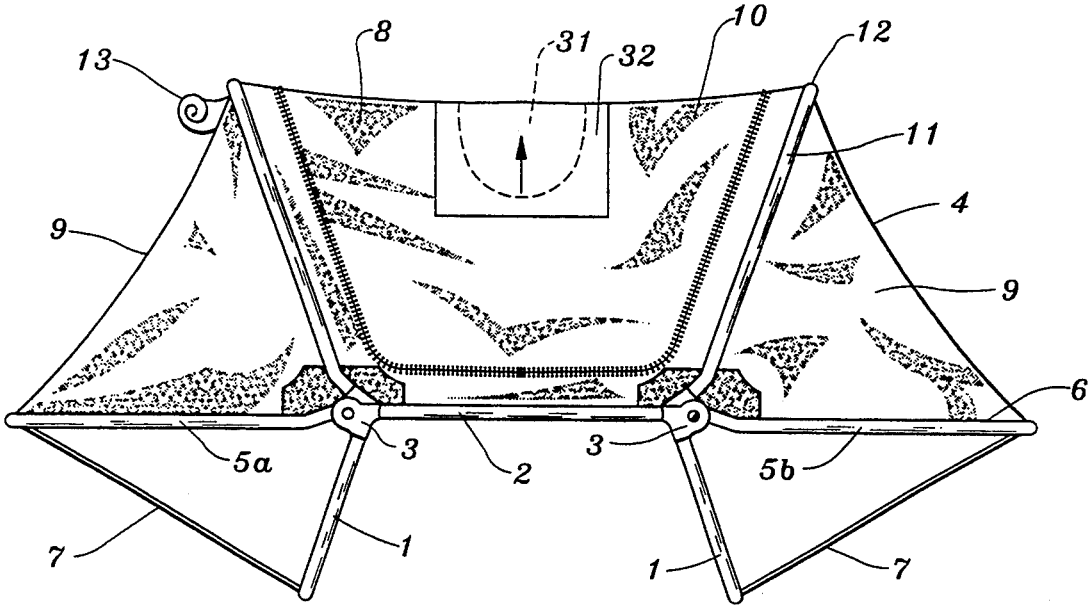
FIG. 1 shows a side view the apparatus in the tent configuration.

The present invention overcomes the problems of lack of comfort in ordinary tents and also provides a personalized shelter for a disaster/communal living situation. Referring now to FIG. 1, the device includes a tubular frame including legs 1 for supporting the frame above the ground. The legs are attached to a central member 2 by hinges 3. By splaying the legs 1 slightly from a perpendicular position with respect to the plane of the central member 2, the legs have greater stability. The envelope 4 is mounted on the frame by inserting the support member 5 into pouches 6 in the envelope 4 in such a manner that when the device is in the tent configuration as shown in FIG. 1, the tension of the support member 5 being extended causes the bottom of the envelope 4 to be taut. This is achieved by making the length between bottoms of the pouches 6 slightly shorter than the length between the ends of the support member 5 fully extended and is aided by tensioning lines 7. In this way, the top of the tent 8 and the sides 9 biased against the tensioners 7 erects the tent and keeps it erect. FIG. 1 also shows the orientation of the door 10 and ventilation opening 31 with a weather flap 32 for covering said ventilation opening. The door 10 is attached by the use of a zipper. It is contemplated by the invention that the envelope could be sealable in an air tight fashion in an alternate embodiment. The tent is attached to the suspension member 11 by straps 12.

In an alternate embodiment an insulation member is inserted in the pouches 6 and extends between the envelope 4 and the central plane member tarpalin 2 to provide extra insulation and padding for comfort. It is contemplated to use a lightweight insulation material such as bubble wrap, dacron TM, thinsulate TM, or similar material.

Figure 2:
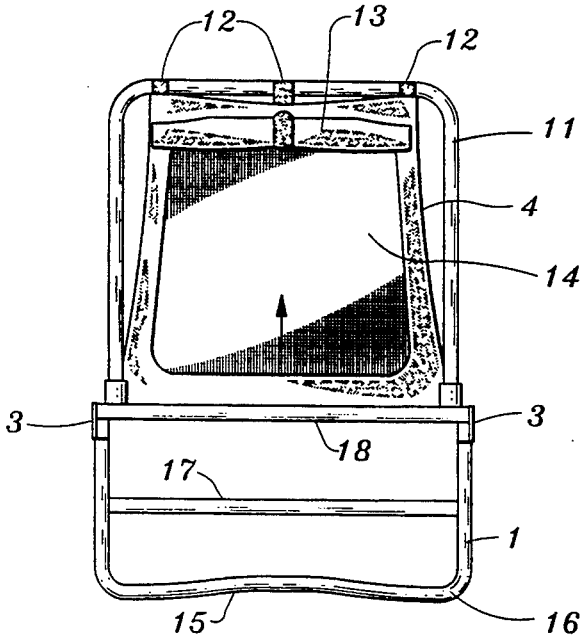
FIG. 2 shows an end view from the window end of the apparatus in the tent configuration.

FIG. 2 is a view of the device from the window end and shows the window 14 and the covering flap therefor 13 in the closed position. It also shows in detail the straps 12 attaching the envelope 4 to the suspension member 11, which suspension member is attached to the hinge 3 at the outside due to the fact that the suspension member has a free arc. With the center strap 12 tightened and side straps loosened, the envelope is peaked for run off. The bend 15 in the bottom of the leg member 1 improves the stability of the device by defining feet 16 which can better grip a surface such as sand or dirt. The leg cross member 17 works against the tarpaulin 18 stretched between central members 2 to keep the tarpaulin 18 under tension.

Figure 3:
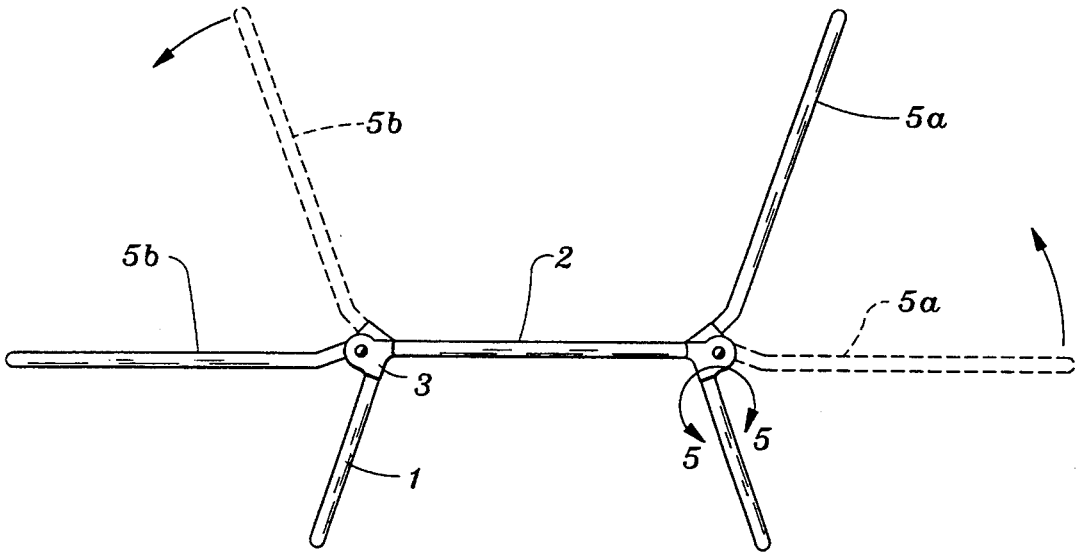
FIG. 3 shows a side view of the apparatus in the lounge configuration with the envelope collapsed.

FIG. 3 shows the device in the lounging configuration where a support member 6 on the end of the device with the window 14 can be locked in a position above the horizontal. In this configuration, the straps 12 are disengaged and the suspension member 11 is oriented coplanar with the suspension member 5A. At the opposite end of the device, suspension member 5B remains in the horizontal position and its corresponding suspension member 11 can either be in a coplanar orientation or left in a relaxed position as shown in FIG. 3. In this configuration, the suspension members are still inserted in their pouches 6 of the envelope therefore providing lateral tension to support the weight of an user. The basic operation of this orientation is much like a lounge chair.

Figure 4:
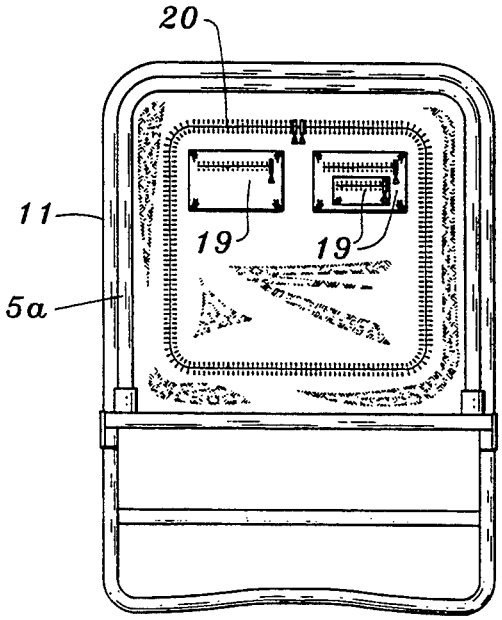
FIG. 4 shows an end view behind the back of the lounge configuration with the envelope collapsed detailing cargo pockets attached to the back of a pouch on said device.

FIG. 4 shows a view from behind the back portion of the chair as shown in FIG. 3 and it shows greater detail of the coplanar orientation of support member 5A and its corresponding suspension member 11. FIG. 4 also shows detachable cargo pockets 19 on a fabric backing that can be attached by zippers to the bottom of the envelope or the pouch 6 on the window end of the device. One of the purposes of providing the window in the backing of the chair is that the netting of the said window is fragile and if it were to be in the place of support member 5B, an user might have a tendency to put their foot through the netting. By placing it on the end of the device of support member 5A, there is less potential for damaging the netting of the window if the user fails to close the window. The cargo pocket configurations on the backing 20 of course anticipate a number of different orientations and different combinations of pockets.

Figure 5:
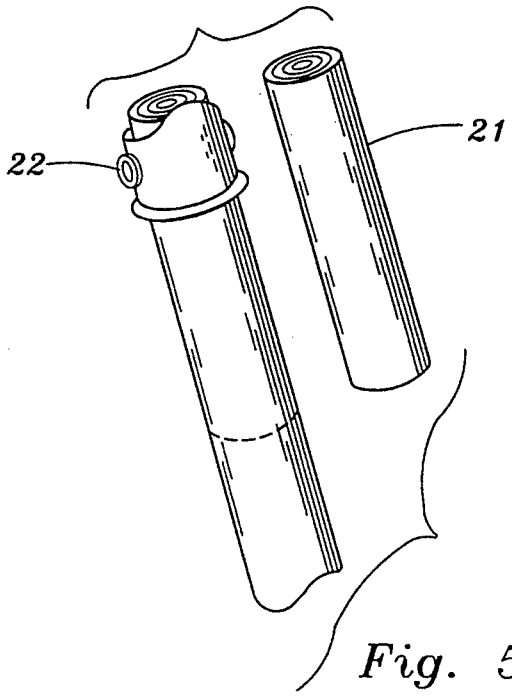
FIG. 5 shows a detailed view of the plugs inserted into the ends of the tubing framework for support and increased rigidity.

FIG. 5 discloses a plug 21 inserted in the ends of each tube at its attachment point and extending down into each tube in order to provide greater rigidity and strength at the stress points. Those being the points of attachment 22. It is anticipated that the use of pins or other removable attaching means will be inserted through the hinge 3 and the various tubes.

Figure 6:
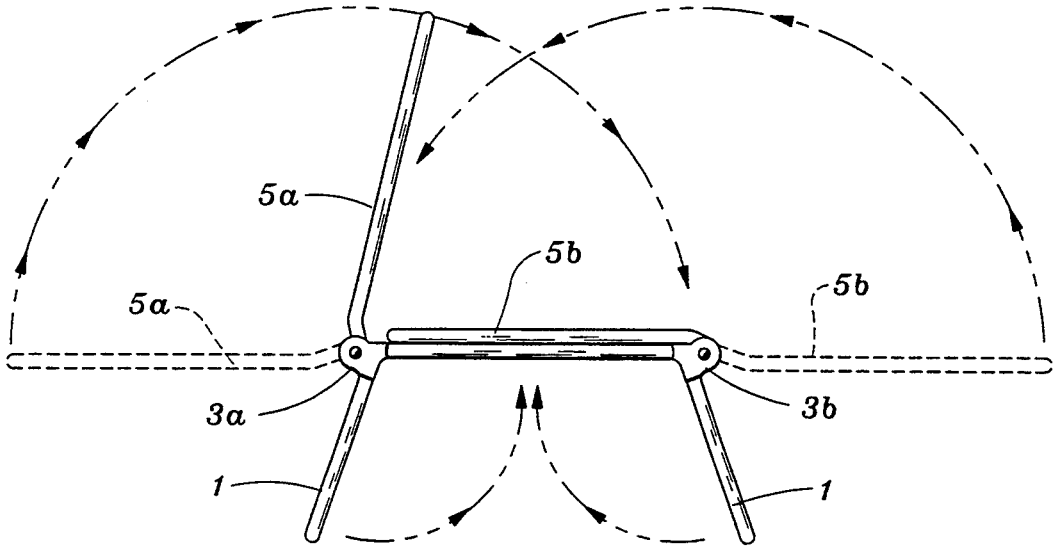
FIG. 6 shows a side view of the apparatus being folded.
Figure 7:
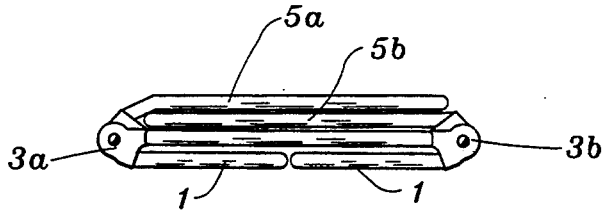
FIG. 7 shows a side view of the apparatus in its collapsed or folded mode.

FIGS. 6 and 7 show the ability of the device to be collapsed for storage and transportation. As shown in FIG. 6, each support member and its corresponding suspension member can be folded parallel to the central member 2. Further, each leg member 1 can be folded under and parallel to the central member 2. Hinge 3A on the same end of the device as support member 5A is offset vertically upward from hinge 3B so that when support member 5B and its corresponding suspension member are folded against central member 2 followed by the folding of support member 5A and its corresponding suspension member, the orientation is parallel and flush as shown in FIG. 7. Obviously the pockets shown on the bottom side of the envelope, which is over support member 5A, would be oriented on the top of the compacted devise shown in FIG. 7.

Figure 8:
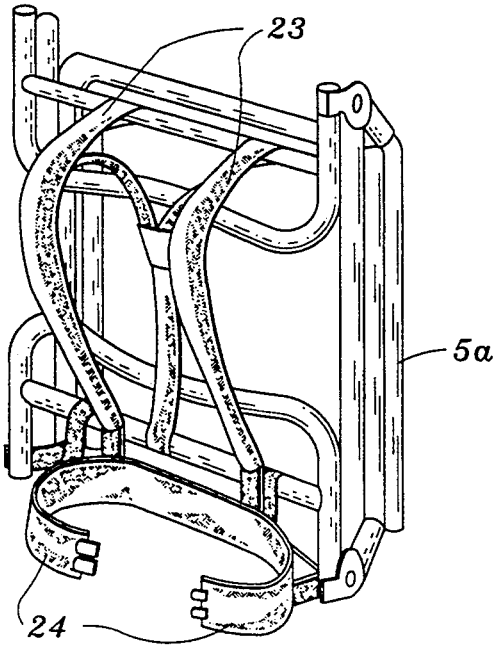
FIG. 8 shows a perspective view of the apparatus in its folded mode and also shows a sample of an alternate embodiment having a convex curvature to the legs and further including a backpack type shoulder strap/carrying belt system.

FIG. 8 shows the device in an alternate embodiment having a frame pack suspension system attached to the frame at two points for shoulder straps 23 and two points for a waist belt 24. The pockets not shown are oriented on the outside of the envelope 6 going over support member 5A and facilitate the use of the device as a frame pack.

Figure 9:
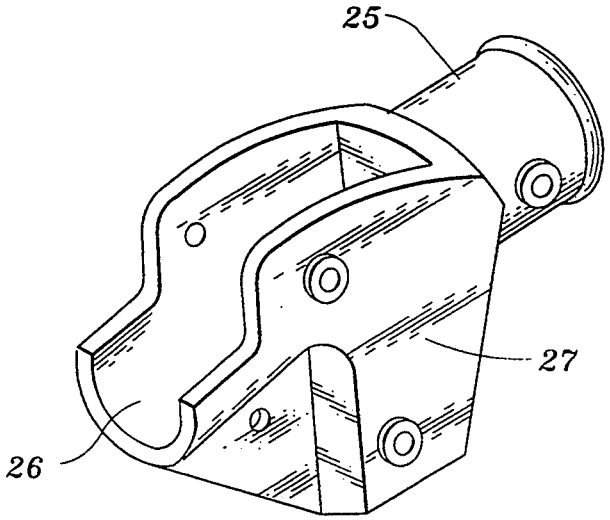
FIG. 9 shows a perspective view of a first hinge.

FIG. 9 discloses hinge 3B as having a cylindrical part 25 which accepts central member 2, and a channel 26 which accepts support member 5B and allows support member 5B a range of arc substantially over 180°, and a channel 27 for leg 1 with a range of motion of substantially 120°. It is contemplated that this hinge will be manufactured of plastic, fiberglass or composite filament resin materials.

Figure 10:
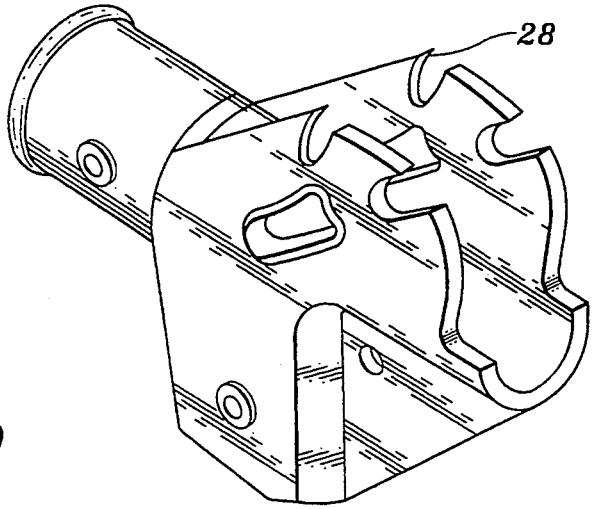
FIG. 10 shows a perspective view of a second multiposition hinge with integral locking and vertical displacement slots used in folding the apparatus to its most compact form.

FIG. 10 shows multi-position hinge 3A being substantially similar to hinge 3B with the addition of slots 28 for offsetting the support member 5A when collapsing the device and by a system of a pin in cooperation with the slot providing a locking means for locking 5A into a semi-vertical position for the lounge configuration of the device.

Figure 11:
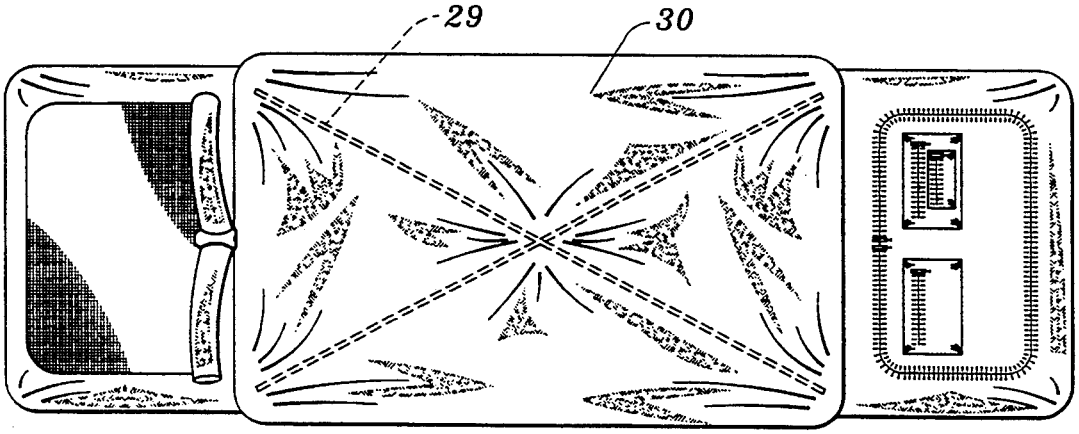
FIG. 11 shows a top view of the apparatus with a secondary weather covering affixed.

FIG. 11 discloses an alternate embodiement of the apparatus with a heavy weather cover 30 supported by cross members 29 attached to suspension members 11.

Figure 12:
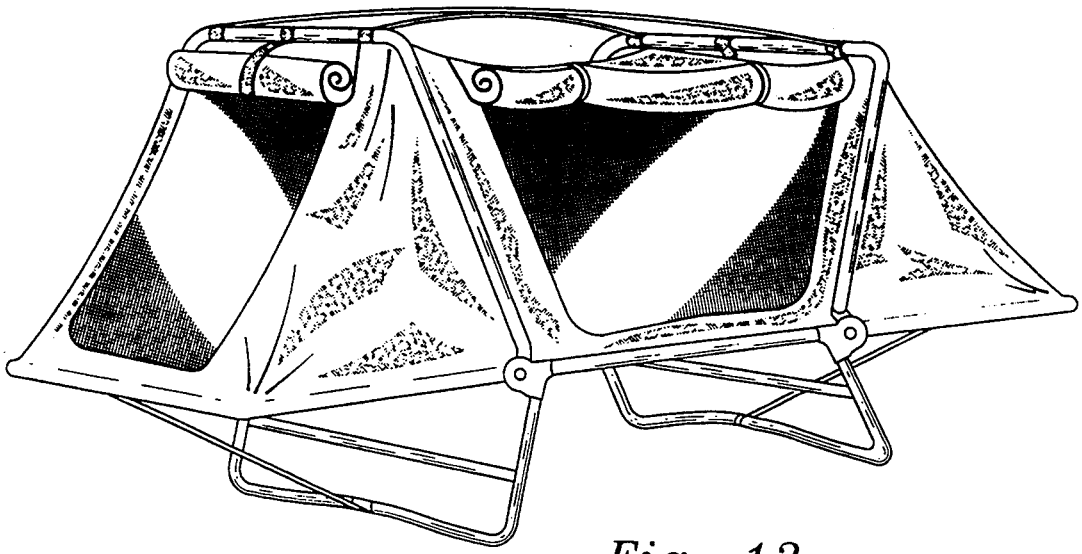
FIG. 12 shows a perspective view of the apparatus with a secondary weather covering affixed.

FIG. 12 shows a perspective view of the above embodiment with the openings open for cross ventilation. Note that FIGS. 11 and 12 show a dome like peak formed by the heavy weather cover 30 which insures superior run off to avoid precipitation accumulation on the top of the envelope.

Obviously this invention is not limited to a one person device, and it contemplates dimensions for two or more people to use the device. It is contemplated by the invention to use lightweight metal tubing of aluminum or lightweight steel, magnesium or similar material. It is also contemplated to use plastics, resin impregnated fiber materials or composites for tubing and the hinges. Many configurations of strapping mechanisms like that shown in FIG. 8 are contemplated and would be obvious variants of the concept shown herein. As previously stated, a number of different pocket configurations are contemplated by that configuration shown in FIG. 4. Materials for plug 21 could include wood, cork, metal or metal nylon, polyesters, or plastic as used in the best mode. It is contemplated to use a rip stop nylon material for the envelope, pouches and tarpaulin, and is contemplated to use other materials for various applications. It is also contemplated to use a number of coatings for weather proofing and keeping out both insects, noxious fumes and particulates as might be necessary. In an alternate embodiment, the legs 1 might be curved concavely with respect to the plane parallel to the central member plane in a backpack configuration in order to provide more freedom or comfort an user of the backpack configuration. It is also contemplated that a foam padding or a mesh netting would be included in the backpack configuration as shown in FIG. 8 for greater comfort and better suspension of the device away from the back of the user. It is also contemplated that in the backpack configuration, the suspension members will comprise flexible members that anchor at the hinges which may be removable or collapsible when collapsing the apparatus. This embodiment would have a narrower aspect and might be easier to wear on an user's back. Finally, it is also contemplated that the envelope be reinforced at points where stress may result from either tension or rubbing with double and triple layers of material or other materials in order to improve wear of device.

Obviously many modifications and variations of the present invention are possible in light of the above teachings. It is therefor to be understood that within the scope of the appended claims, the invention may be practiced other than as specifically described.

What is claimed and desired to be secured by Letters Patent of the United States is:

1. An apparatus comprising a central planar member having hinge means attached at both a first end and a second end opposite said first end; a leg member attached to each said hinge means and extending from a first side of said central planar member, such that said leg members support said central planar member; suspension member attached to each said hinge means, a support member attached to each said hinge means, and an envelope having at least one opening for ingress, egress attached to said support members by a first attachment means, and suspended from said suspension members by a second attachment means, comprising multiple configurations, wherein a first configuration comprises coplanar pairs comprising a suspension member oriented coplanar to a corresponding support member which is attached to the same hinge means, both said members being substantially coplanar with said central planar member; said second attachment means are not engaged and said first attachment means are engaged such that said apparatus operates as a cot where said members and said envelope cooperate to provide support to an user laying on said apparatus, further comprising a second configuration, having a coplanar pair comprising a suspension member and a support member locked into an orientation of some angle above a horizontal plane of said central planar member, away from said leg members, such that said apparatus acts as a lounge chair, to support an user seated on said central planar member with the user's body against said back of coplanar pair, further comprising a third configuration wherein said support members are oriented substantially parallel to said central planar member and said suspension members are oriented extending away from said central planar member in a direction opposite said leg members; said first attachment means attaching said envelope to said suspension members are engaged and said second attachment means attaching said envelope to said support members are engaged such that said envelope is uncollapsed, further comprising a fourth configuration wherein said leg members are oriented substantially parallel to said central planar member, a first coupling of said support and suspension members are oriented coplanar to each other and substantially parallel to said central planar member, a second coupling said support and suspension members are oriented coplanar to each other and substantially parallel to said central planar member, wherein said central planar member comprises at least two parallel tubes joined by a tarpaulin stretched between them, wherein said hinge means comprises a first cylindrical portion for accepting said tube of said central planar member at a first end, and a first hinge attaching means for attaching said tube to said hinge, a channel for accepting said support member at an opposite end said channel being open such that said support member is free to move through an area of substantially 180°, said channel formed as a partial cylinder cut along an axis parallel to a longitudinal axis of said cylinder such that said support member gets support from said hinge, when under weight said channel extends a distance from said first cylindrical portion to prevent binding through the arc of said support member, a second hinge attachment means for attaching said support member to said hinge in said channel; a second channel for attaching said leg member extends substantially perpendicularly to a central axis of said first cylindrical portion and said first channel, oriented such that the are of said leg member is coplanar with the arc of said support member; said leg member must be capable of moving through an arc of up to 135°, a third hinge attachment means for attaching said leg member to said second channel, and a fourth hinge attachment for attaching a suspension member to said hinge.

2. An apparatus as described in claim 1 wherein said hinge further comprises locking means for locking said support member in said first configuration.

3. An apparatus as described in claim 2 wherein said first attachment means comprises a pouch in said envelope for accepting said support member such that said envelope is a tent when said support members are in said third configuration.

4. An apparatus as described in claim 3 further comprising a tensioning means for applying tension to a said leg member and a said support member which share a common pair of hinges for biasing said members against their respective hinge channel walls in order to make said leg member more sturdy and to tension said envelope in said third configuration.

5. An apparatus as described in claim 4 wherein said opening in said envelope comprises a zippered door, said zipper extending from a point on said envelope away from said central planar member near a first of said suspension members and extending substantially toward the plane of said central planar member, parallel to said plan and symmetrically away again, thus forming a flap attached to said envelope for protection from precipitation.

6. An apparatus as described in claim 5 further comprising a second opening in said envelop for ventilation and ingress, egress.

7. An apparatus as described in claim 6 wherein said hinge attachment means comprise plugs inserted in the ends of said members comprising tubes for greater rigidity at said attachment points and pins through said hinges and members to act as pivot points.

8. An apparatus as described in claim 7 further comprising netting that can be drawn over said openings and attached to prevent insects from entering said envelope.

9. An apparatus as described in claim 8 further comprising a system of shoulder straps and belt attached to the rigid frame of said apparatus for placing said device on the back of an user in a manner similar to a framed backpack.

10. An apparatus as described in claim 9 further comprising cargo pockets attached to a pouch of said envelope for carrying items while in a backpack configuration.

11. An apparatus as described in claim 10 further comprising a removable pocket backing with cargo pockets attached thereto such that said pocket backing is removably attached to said envelope pouch.

* * * * *